US011174866B1

(12) United States Patent
Ito et al.

(10) Patent No.: US 11,174,866 B1
(45) Date of Patent: Nov. 16, 2021

(54) CENTRIFUGAL COMPRESSOR

(71) Applicant: KABUSHIKI KAISHA TOYOTA JIDOSHOKKI, Aichi-ken (JP)

(72) Inventors: Shogo Ito, Kariya (JP); Ryosuke Fukuyama, Kariya (JP); Kaho Takeuchi, Kariya (JP); Daisuke Watanabe, Kariya (JP); Yohei Takase, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 17/238,888

(22) Filed: Apr. 23, 2021

(30) Foreign Application Priority Data

May 1, 2020 (JP) ..... JP2020-081288

(51) Int. Cl.

| | |
|---|---|
| ***F04D 17/10*** | (2006.01) |
| ***F04D 29/053*** | (2006.01) |
| ***F04D 29/10*** | (2006.01) |
| ***F04D 29/063*** | (2006.01) |

(52) U.S. Cl.
CPC ..... *F04D 17/10* (2013.01); *F04D 29/053* (2013.01); *F04D 29/063* (2013.01); *F04D 29/102* (2013.01)

(58) Field of Classification Search
CPC ..... F04D 29/063; F01D 25/18; F01D 25/183; F01D 25/20; F05D 2260/98
See application file for complete search history.

(56) References Cited

U.S. PATENT DOCUMENTS

| | | | | |
|---|---|---|---|---|
| 5,423,304 | A * | 6/1995 | Lawrence | F02B 33/40 123/559.1 |
| 5,746,676 | A * | 5/1998 | Kawase | F16H 15/22 475/214 |
| 2016/0281740 | A1 | 9/2016 | Mitsuda et al. | |
| 2018/0087520 | A1* | 3/2018 | Snyder | F16N 39/06 |
| 2018/0231116 | A1* | 8/2018 | Kobayashi | F01M 11/02 |
| 2019/0277301 | A1 | 9/2019 | Fukuyama et al. | |
| 2020/0102964 | A1* | 4/2020 | Nakane | F04D 27/009 |
| 2021/0215171 | A1* | 7/2021 | Fujita | F04D 29/4206 |

FOREIGN PATENT DOCUMENTS

| | | |
|---|---|---|
| JP | 2016-186238 | 10/2016 |
| JP | 2019-157707 | 9/2019 |

* cited by examiner

*Primary Examiner* — John Kwon
(74) *Attorney, Agent, or Firm* — Greenblum & Bernstein, P.L.C.

(57) ABSTRACT

A pressure relief passage includes a first pressure relief passage and a second pressure relief passage. A pressure relief hole is provided in an upper part of the first pressure relief passage in the direction of gravitational force. The second pressure relief passage merges with the first pressure relief passage to form a merging portion. The cross-sectional flow area of a stagnation portion, which is the maximum cross-sectional flow area of the second pressure relief passage, is smaller than the cross-sectional flow area of a connection passage, which is the minimum cross-sectional flow area of the first pressure relief passage.

6 Claims, 7 Drawing Sheets

CENTRIFUGAL COMPRESSOR

BACKGROUND

1. Field

The present disclosure relates to a centrifugal compressor.

2. Description of Related Art

Japanese Laid-Open Patent Publication No. 2016-186238 discloses a centrifugal compressor. The centrifugal compressor includes a low speed shaft, an impeller attached to a high speed shaft, and a speed increaser that transmits power from the low speed shaft to the high speed shaft. The centrifugal compressor further includes a housing and a dividing wall. The housing includes an impeller chamber, which accommodates the impeller, and a speed increaser chamber, which accommodates the speed increaser. The dividing wall divides the impeller chamber and the speed increaser chamber from each other. The dividing wall has an insertion hole through which the high speed shaft is passed. The centrifugal compressor also includes a seal member, an oil pan, and an oil passage. The seal member is provided between the outer circumferential surface of the high speed shaft and the inner circumferential surface of the insertion hole. The oil pan stores oil to be supplied to the speed increaser. The oil passage supplies oil stored in the oil pan to the speed increaser and returns the oil to the oil pan. The oil supplied to the speed increaser reduces friction and prevents seizure in sliding portions of the high speed shaft and the speed increaser. The seal member prevents leakage of the oil stored in the speed increaser chamber into the impeller chamber through the insertion hole.

When gas is compressed through rotation of the impeller, the internal pressure of the impeller chamber is increased. The compressed gas flows from the edge of the back face of the impeller to the clearance on the back face of the impeller. This increases the pressure of the clearance on the back face of the impeller. The gas may leak from the clearance on the back face of the impeller to the speed increaser chamber through the gap between the outer circumferential surface of the high speed shaft and the inner circumferential surface of the insertion hole, which may increase the pressure in the speed increaser chamber. Also, the pressure in the impeller chamber may become lower than the pressure in the speed increaser chamber, for example, when the impeller is rotating at a low speed or when the centrifugal compressor is in a stopped state. In this case, the oil in the speed increaser chamber may leak to the impeller chamber through the gap between the outer circumferential surface of the high speed shaft and the inner circumferential surface of the insertion hole.

For example, Japanese Laid-Open Patent Publication No. 2019-157707 discloses a centrifugal compressor that includes a pressure relief passage. The pressure relief passage connects an oil pan and the outside of the centrifugal compressor (the atmosphere side) to limit an increase in the pressure in the speed increaser chamber. This configuration releases pressure through a pressure relief hole of the pressure relief passage if the pressure in the speed increaser chamber increases. This limits an increase in the pressure in the speed increaser chamber.

Since oil is supplied to the speed increaser, the oil accumulates in the speed increaser chamber. The oil accumulated in the speed increaser chamber is stirred by the speed increaser. This generates bubbles in the oil. The bubbles generated in the oil reach the pressure relief passage from the speed increaser via the oil pan, and are retained in the pressure relief passage. Thus, when the bubbles in the oil are retained in the pressure relief passage, the level of the oil rises. When the level of the oil reaches the pressure relief hole of the pressure relief passage, the oil may leak from the opening of the pressure relief hole.

SUMMARY

It is an objective of the present disclosure to provide a centrifugal compressor that is capable of preventing the level of oil from reaching a pressure relief hole of a pressure relief passage.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a centrifugal compressor includes a low speed shaft that is rotated by a drive source, an impeller that is attached to a high speed shaft, which rotates at a speed higher than a speed of the low speed shaft, a speed increaser that transmits power of the low speed shaft to the high speed shaft, a housing, a seal member, an oil pan, and a pressure relief passage. The housing includes a drive source chamber that accommodates the drive source, an impeller chamber that accommodates the impeller, a speed increaser chamber that accommodates the speed increaser, and a dividing wall having an insertion hole through which the high speed shaft is passed. The dividing wall divides the impeller chamber and the speed increaser chamber from each other. The seal member is provided between an outer circumferential surface of the high speed shaft and an inner circumferential surface of the insertion hole. The oil pan stores oil supplied to the speed increaser. The pressure relief passage connects an upper part of the oil pan to a pressure relief hole that opens in an outer surface of the housing. The pressure relief passage includes a first pressure relief passage and a second pressure relief passage. The pressure relief hole is arranged above the first pressure relief passage in a direction of gravitational force. The second pressure relief passage merges with the first pressure relief passage to form a merging portion. A maximum cross-sectional flow area of the second pressure relief passage is smaller than a minimum cross-sectional flow area of the first pressure relief passage.

In another general aspect, a centrifugal compressor includes a low speed shaft that is rotated by a drive source, an impeller that is attached to a high speed shaft, which rotates at a speed higher than a speed of the low speed shaft, a speed increaser that transmits power of the low speed shaft to the high speed shaft, a housing, a seal member, an oil pan, and a pressure relief passage. The housing includes a drive source chamber that accommodates the drive source, an impeller chamber that accommodates the impeller, a speed increaser chamber that accommodates the speed increaser, and a dividing wall having an insertion hole through which the high speed shaft is passed. The dividing wall divides the impeller chamber and the speed increaser chamber from each other. The seal member is provided between an outer circumferential surface of the high speed shaft and an inner circumferential surface of the insertion hole. The oil pan stores oil supplied to the speed increaser via an oil passage. The pressure relief passage connects an upper part of the oil pan to a pressure relief hole that opens in an outer portion of the housing. The pressure relief passage includes a first pressure relief passage and a detouring pressure relief passage. The pressure relief hole is arranged above the first pressure relief passage in a direction of gravitational force. The detouring pressure relief passage includes a detouring pressure relief passage that extends, in a detouring manner, from a lower part of the first pressure relief passage to a region located in an upper part. A minimum cross-sectional flow area of the detouring pressure relief passage is smaller than a minimum cross-sectional flow area of the first pressure relief passage.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A centrifugal compressor 10 according to an embodiment will now be described with reference to FIGS. 1 to 5. The centrifugal compressor 10 of the present embodiment is mounted on a fuel cell vehicle that travels using a fuel cell as a power source. The centrifugal compressor 10 supplies air to the fuel cell. In the following description, the terms "upper," "upward," "above," "lower," "downward," "below," and other terms indicating vertical positional relationships are defined with reference to the direction of gravitational force.

Figure 1:
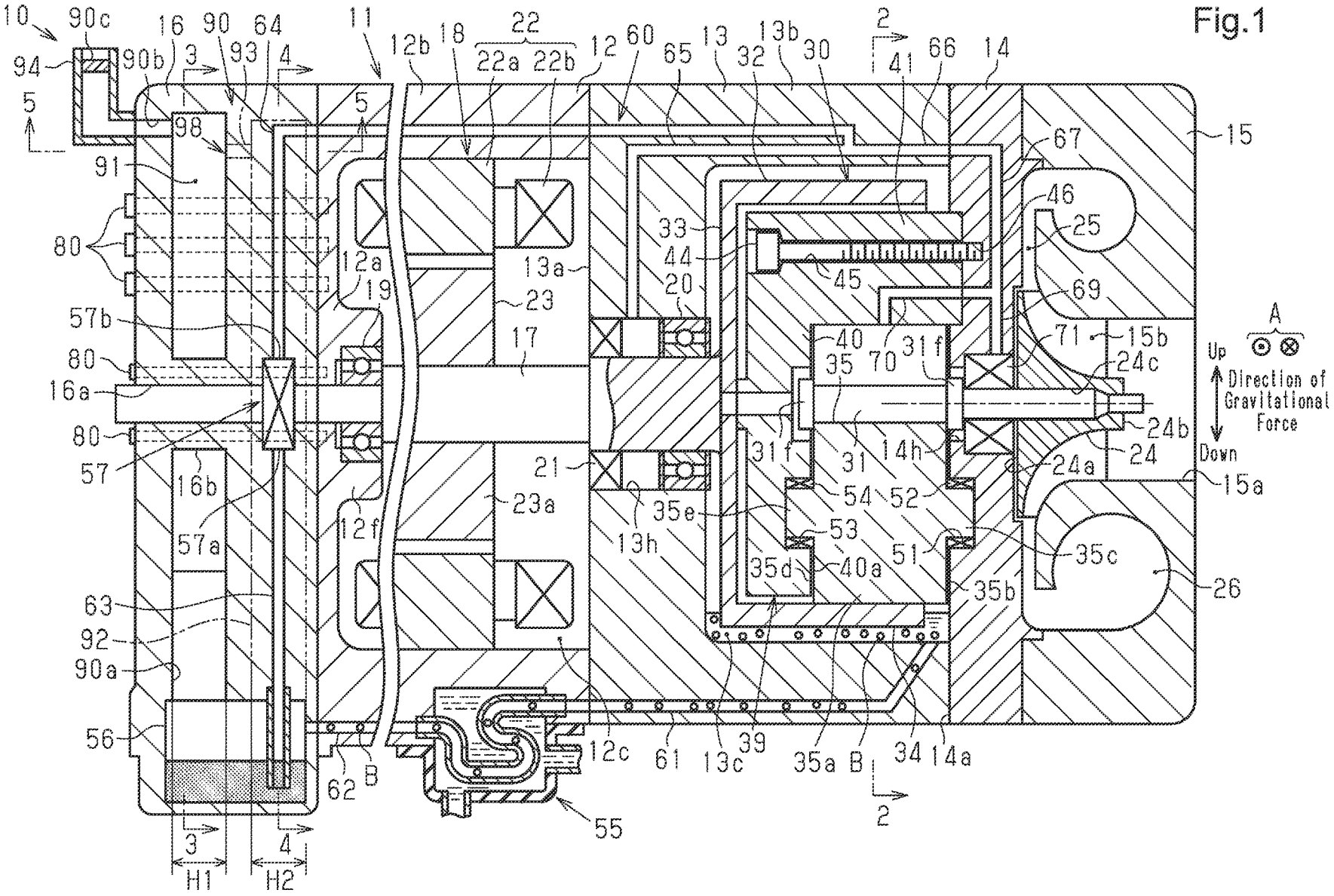
FIG. 1 is a cross-sectional side view showing a centrifugal compressor according to an embodiment.

As shown in FIG. 1, the centrifugal compressor 10 includes a substantially tubular housing 11. The housing 11 includes a motor housing member 12, a speed increaser housing member 13, a plate 14, a compressor housing member 15, and a rear housing member 16. The speed increaser housing member 13 is coupled to the motor housing member 12. The plate 14 is coupled to the speed increaser housing member 13. The compressor housing member 15 is coupled to the plate 14. The rear housing member 16 is coupled to the motor housing member 12 on the side opposite to the speed increaser housing member 13. The motor housing member 12 and the speed increaser housing member 13 each have a cylindrical shape with a closed end. The motor housing member 12, the speed increaser housing member 13, the plate 14, the compressor housing member 15, and the rear housing member 16 are made of metal such as aluminum, and are arranged in that order in the axial direction of the housing 11.

The housing 11 includes a motor chamber 12*c*, which is a drive source chamber accommodating an electric motor 18, a speed increaser chamber 13*c*, which accommodates a speed increaser 30, and an impeller chamber 15*b*, which accommodates an impeller 24. The motor chamber 12*c* is defined by the inner surface of a disc-shaped bottom wall 12*a* and the inner circumferential surface of a peripheral wall 12*b* of the motor housing member 12, and the outer surface of a bottom wall 13*a* of the speed increaser housing member 13. That is, an opening of the peripheral wall 12*b* on a side opposite to the bottom wall 12*a* is closed by the bottom wall 13*a* of the speed increaser housing member 13. The bottom wall 12*a* has a tubular boss 12*f* protruding from the inner surface. The rear housing member 16 is coupled to the bottom wall 12*a*. The rear housing member 16 has an insertion hole 16*a* in a center portion. A low speed shaft 17, which extends through the bottom wall 12*a*, is passed through the insertion hole 16*a*. The low speed shaft 17 will be discussed below. The motor housing member 12 and the rear housing member 16 are fastened to each other by bolts 80. The bolts 80 extend through the rear housing member 16 and are threaded to the bottom wall 12*a* of the motor housing member 12.

The speed increaser chamber 13*c* is defined by the inner surface of the disc-shaped bottom wall 13*a* and the inner circumferential surface of the peripheral wall 13*b* of the speed increaser housing member 13, and the plate 14. That is, an opening of the peripheral wall 13*b* on a side opposite to the bottom wall 13*a* is closed by a surface 14*a* of the plate 14. The bottom wall 13*a* has a through-hole 13*h* in a center portion. The speed increaser chamber 13*c* stores oil.

The impeller chamber 15*b* is defined by the compressor housing member 15 and the plate 14. The compressor housing member 15 is coupled to a surface of the plate 14 on a side opposite to the speed increaser housing member 13. The compressor housing member 15 includes a suction port 15*a*, through which air, which is fluid, is drawn in. The suction port 15*a* is located at in a center portion of the end face of the compressor housing member 15 on the side opposite to the plate 14. The suction port 15*a* extends in the axial direction of the housing 11 from the center portion of that end face of the compressor housing member 15. The impeller chamber 15*b* and the suction port 15*a* are connected to each other. The impeller chamber 15*b* is substantially truncated cone-shaped with its diameter gradually increasing as the distance from the suction port 15*a* increases. A high speed shaft 31, which will be discussed below, protrudes into the compressor housing member 15.

The plate 14 is a dividing wall that divides the impeller chamber 15*b* and the speed increaser chamber 13*c* from each other. The plate 14 has an insertion hole 14*h*, through which the high speed shaft 31 is passed.

As shown in FIG. 1, the centrifugal compressor 10 includes the electric motor 18, which is a drive source, the low speed shaft 17, which is rotated by the electric motor 18, the high speed shaft 31, which rotates at a speed higher than the speed of the low speed shaft 17, and the speed increaser 30, which transmits the power of the low speed shaft 17 to the high speed shaft 31.

The electric motor 18 includes a tubular stator 22 and a rotor 23, which is arranged on the inner side of the stator 22. The rotor 23 is fixed to the low speed shaft 17 and rotates integrally with the low speed shaft 17. The stator 22 surrounds the rotor 23. The rotor 23 includes a cylindrical rotor core 23*a*, which is fixed to the low speed shaft 17, and permanent magnets (not shown), which are provided in the rotor core 23*a*. The stator 22 includes a tubular stator core 22*a* and a coil 22*b*. The stator core 22*a* is fixed to the inner circumferential surface of the peripheral wall 12*b* of the motor housing member 12. The coil 22*b* is wound about the stator core 22*a*. Current through the coil 22*b* causes the rotor 23 and the low speed shaft 17 to rotate integrally.

The axial direction of the low speed shaft 17 agrees with the axial direction of the motor housing member 12. In this state, the low speed shaft 17 is accommodated in the motor housing member 12. The low speed shaft 17 has a first end inserted into the boss 12*f*. A first bearing 19 is provided between the first end of the low speed shaft 17 and the boss 12*f*. The first end of the low speed shaft 17 is rotationally supported by the bottom wall 12*a* of the motor housing member 12 with the first bearing 19. The first end of the low speed shaft 17 is passed through the bottom wall 12*a* of the motor housing member 12 and the insertion hole 16*a* of the rear housing member 16, and protrudes to the outside.

The low speed shaft 17 has a second end inserted into the through-hole 13*h*. A second bearing 20 is provided between the second end of the low speed shaft 17 and the through-hole 13*h*. The second end of the low speed shaft 17 is rotationally supported by the bottom wall 13*a* of the speed increaser housing member 13 with the second bearing 20. The low speed shaft 17 is thus rotationally supported by the housing 11. The second end of the low speed shaft 17 extends from the motor chamber 12*c* through the through-hole 13*h*, and protrudes into the speed increaser housing member 13.

A seal member 21 is provided between the second end of the low speed shaft 17 and the inner circumferential surface of the through-hole 13*h*. The seal member 21 is arranged between the second bearing 20 and the motor chamber 12*c*. The seal member 21 prevents leakage of oil stored in the speed increaser chamber 13*c* to the motor chamber 12*c* through the gap between the outer circumferential surface of the low speed shaft 17 and the inner circumferential surface of the through-hole 13*h*.

The high speed shaft 31 is accommodated in the speed increaser chamber 13*c*. An end of the high speed shaft 31 that is on a side opposite to the motor housing member 12 extends through the insertion hole 14*h* of the plate 14 and protrudes into the compressor housing member 15. The axis of the high speed shaft 31 agrees with the axis of the low speed shaft 17.

The speed increaser 30 accelerates rotation of the low speed shaft 17 and transmits the rotation to the high speed shaft 31. The speed increaser 30 is of a traction drive type (a friction roller type). The speed increaser 30 includes a ring member 32, which is coupled to the second end of the low speed shaft 17. The ring member 32 is made of metal. The ring member 32 includes a disc-shaped base 33, which is coupled to the second end of the low speed shaft 17, and a tubular portion 34, which cylindrically extends from the outer edge of the base 33. The ring member 32 has a cylindrical shape with a closed end. The base 33 extends in the radial direction of the low speed shaft 17 with respect to the low speed shaft 17. The axis of the tubular portion 34 agrees with the axis of the low speed shaft 17.

Figure 2:
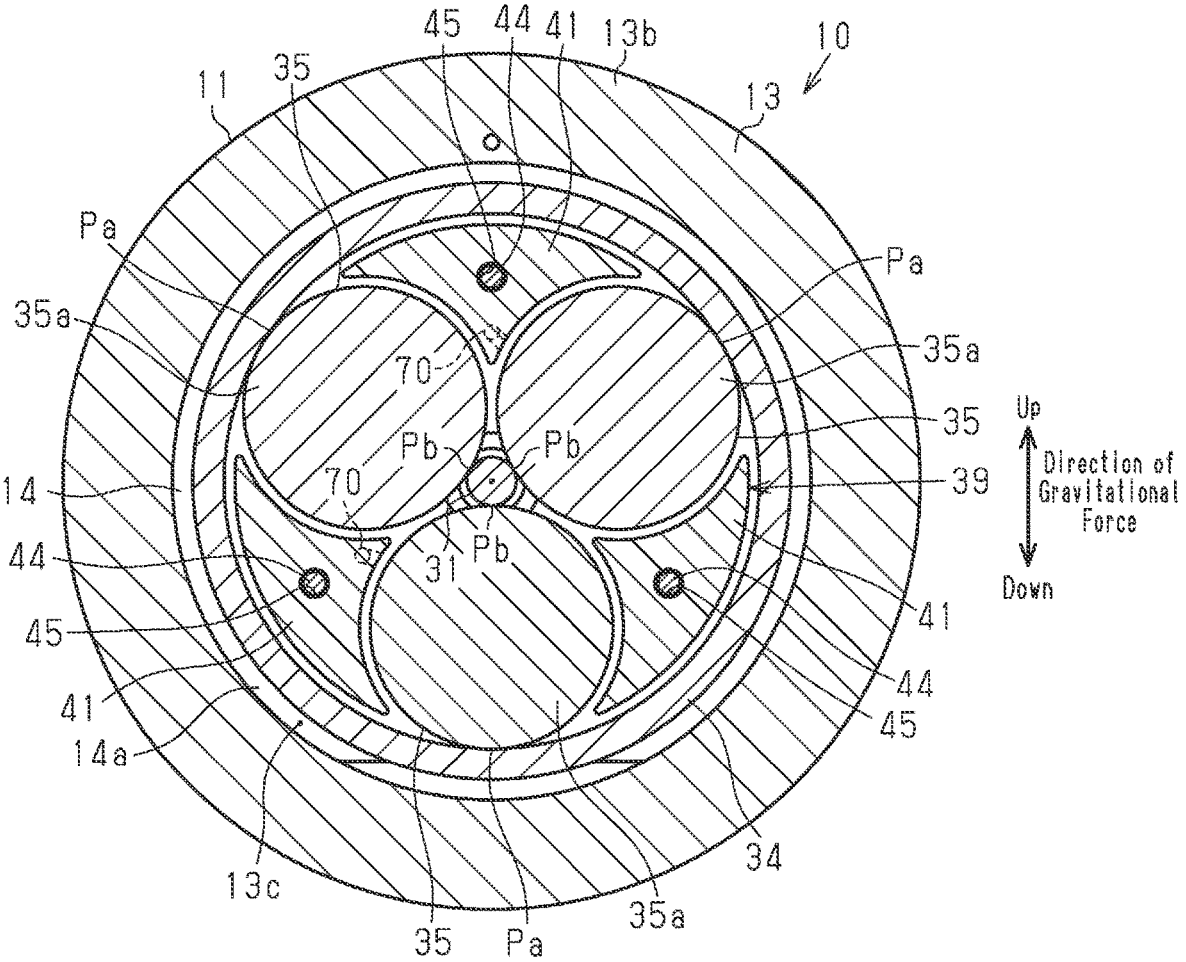
FIG. 2 is a cross-sectional view taken along line 2-2 in FIG. 1.

As shown in FIG. 2, part of the high speed shaft 31 is arranged inward of the tubular portion 34. The speed increaser 30 includes three rollers 35, which are provided between the tubular portion 34 and the high speed shaft 31. The three rollers 35 are arranged at predetermined intervals (for example, 120 degrees) in the circumferential direction of the high speed shaft 31. The three rollers 35 have the same shape. The three rollers 35 contact both of the inner circumferential surface of the tubular portion 34 and the outer circumferential surface of the high speed shaft 31.

As shown in FIG. 1, each roller 35 includes a columnar roller portion 35*a*, a columnar first protrusion 35*c*, and a columnar second protrusion 35*e*. The first protrusion 35*c* protrudes from a first end face 35*b* in the axial direction of the roller portion 35*a*. The second protrusion 35*e* protrudes from a second end face 35*d* in the axial direction of the roller portion 35*a*. The axis of the roller portion 35*a*, the axis of the first protrusion 35*c*, and the axis of the second protrusion 35*e* agree with one another. The axial direction of the roller portion 35*a* of each roller 35 and the axial direction of the high speed shaft 31 agree with each other.

As shown in FIGS. 1 and 2, the speed increaser 30 includes a support member 39, which cooperates with the plate 14 to rotationally support the rollers 35. The support member 39 is arranged inward of the tubular portion 34. The support member 39 includes a disc-shaped support base 40 and three pillar-shaped upright walls 41, which project from the support base 40. The support base 40 is arranged to be opposed to the plate 14 in the axial direction of the rollers 35. The three upright walls 41 extend toward the plate 14 from a surface 40*a* of the support base 40 that is closest to the plate 14. The three upright walls 41 are arranged so as to fill the three spaces, each of which is defined by the outer circumferential surfaces of adjacent two of the roller portions 35*a* and the inner circumferential surface of the tubular portion 34.

The support member 39 has three bolt insertion holes 45, through which bolts 44 are passed. Each bolt insertion hole 45 extends in the axial direction of the rollers 35 through corresponding one of the three upright walls 41. As shown in FIG. 1, the plate 14 has internal thread holes 46 in the surface 14*a*, which is closest to the support member 39. The internal thread holes 46 are connected to the bolt insertion holes 45. The support member 39 is attached to the plate 14 by threading the bolts 44, which are passed through the bolt insertion holes 45, into the internal thread holes 46.

The plate 14 has three recesses 51 (only one of the recesses 51 is shown in FIG. 1) in the surface 14*a*. The three recesses 51 are arranged at predetermined intervals (for example, 120 degrees) in the circumferential direction of the high speed shaft 31. The three recesses 51 each receive an annular roller bearing 52.

The support base 40 has three recesses 53 (only one of the recesses 53 is shown in FIG. 1) in the surface 40*a* that is closest to the plate 14. The three recesses 53 are arranged at predetermined intervals (for example, 120 degrees) in the circumferential direction of the high speed shaft 31. The three recesses 53 each receive an annular roller bearing 54.

The first protrusion 35*c* of each roller 35 is inserted into the roller bearing 52 in the corresponding recess 51, and is rotationally supported by the plate 14 with the roller bearing 52. The second protrusion 35*e* of each roller 35 is inserted into the roller bearing 54 in the corresponding recess 53, and is rotationally supported by the support member 39 with the roller bearing 54.

The high speed shaft 31 includes two flanges 31*f*, which are arranged at positions spaced apart to be opposed to each other in the axial direction of the high speed shaft 31. The roller portions 35*a* of the three rollers 35 are held by the two flanges 31*f*. This prevents positional displacement of the high speed shaft 31 and the roller portions 35*a* of the three rollers 35 in the axial direction of the high speed shaft 31.

As shown in FIG. 2, the three rollers 35 are pressed against the high speed shaft 31 and the tubular portion 34. The three rollers 35, the ring member 32, and the high speed shaft 31 are unitized in this state. The high speed shaft 31 is rotationally supported by the three rollers 35.

The contacting section between the outer circumferential surface of the roller portion 35*a* of each of the three rollers 35 and the inner circumferential surface of the tubular portion 34 is referred to as a ring-side contacting section Pa, to which pressing load is applied. The contacting section between the outer circumferential surface of each of the three rollers 35 and the outer circumferential surface of the high speed shaft 31 is referred to as a shaft-side contacting section Pb, to which pressing load is applied. The ring-side contacting sections Pa and the shaft-side contacting sections Pb extend in the axial direction of the high speed shaft 31.

As shown in FIG. 1, the centrifugal compressor 10 includes the impeller 24, which is attached to the high speed shaft 31. The impeller 24 is tubular and has a diameter that gradually decreases from a proximal end face 24*a* toward a distal end face 24*b*. The impeller 24 has an insertion hole 24*c*, which extends in the axial direction of the impeller 24. The high speed shaft 31 can be passed through the insertion hole 24*c*. The end of the high speed shaft 31 that protrudes into the compressor housing member 15 is passed through the insertion hole 24*c*. The impeller 24 is attached to the high speed shaft 31 in this state. When the high speed shaft 31 rotates, the impeller 24 rotates, so that air drawn through the suction port 15*a* is compressed. The impeller 24 rotates integrally with the high speed shaft 31 to compress the air. The proximal end face 24*a* is an impeller back face.

As shown in FIG. 1, the centrifugal compressor 10 includes a diffuser passage 25, into which the air compressed by the impeller 24 flows, and a discharge chamber 26, into which the air that has passed through the diffuser passage 25 flows.

As shown in FIG. 1, the diffuser passage 25 is defined by the surface of the compressor housing member 15 that is opposed to the plate 14 and the surface of the plate 14 that is opposed to the compressor housing member 15. The diffuser passage 25 is located outward of the impeller chamber 15*b* in the radial direction of the high speed shaft 31, surrounding the impeller chamber 15*b*. The diffuser passage 25 is annular.

As shown in FIG. 1, the discharge chamber 26 is located outward of the diffuser passage 25 in the radial direction of the high speed shaft 31, and is connected to the diffuser passage 25. The discharge chamber 26 is annular. The impeller chamber 15*b* and the discharge chamber 26 are connected to each other by the diffuser passage 25. Air that has been compressed by the impeller 24 flows through the diffuser passage 25 to be compressed further, and flows to the discharge chamber 26 to be discharged from the discharge chamber 26.

As shown in FIG. 1, the centrifugal compressor 10 includes a seal member 71 provided in the insertion hole 14*h*. The seal member 71 is provided between the outer circumferential surface of the high speed shaft 31 and the inner circumferential surface of the insertion hole 14*h*. The seal member 71 is a mechanical seal. The seal member 71 prevents leakage of oil stored in the speed increaser chamber 13*c* to the impeller chamber 15*b* through the insertion hole 14*h*.

As shown in FIG. 1, the centrifugal compressor 10 includes an oil pan 56, an oil passage 60, an oil cooler 55, and an oil pump 57. The oil pan 56 stores oil supplied to the speed increaser 30. The oil passage 60 supplies oil stored in the oil pan 56 to the speed increaser 30, and returns the oil to the oil pan 56. The oil cooler 55 cools oil flowing to the oil passage 60. The oil pump 57 pumps the oil stored in the oil pan 56 and discharges the oil.

As shown in FIG. 1, the oil passage 60 includes a first connection passage 61, which connects the speed increaser chamber 13*c* and the oil cooler 55 to each other. The first connection passage 61 has a first end, which opens in the speed increaser chamber 13*c*. The first connection passage 61 has a second end, which is connected to the oil cooler 55.

The centrifugal compressor 10 is mounted on the fuel cell vehicle such that the opening of the first connection passage 61 that opens in the speed increaser chamber 13*c* is located in the lower part.

The oil passage 60 includes a second connection passage 62, which connects the oil cooler 55 and the oil pan 56 to each other. The second connection passage 62 has a first end, which is connected to the oil cooler 55. The second connection passage 62 has a second end, which opens in the oil pan 56.

The oil passage 60 includes a third connection passage 63, which connects the oil pan 56 and the oil pump 57 to each other. The third connection passage 63 is formed in the rear housing member 16. The third connection passage 63 has a first end, which protrudes into the oil pan 56. The third connection passage 63 has a second end, which is connected to a suction port 57*a* of the oil pump 57.

The oil passage 60 is connected to a discharge port 57*b* of the oil pump 57. The oil passage 60 extends into the peripheral wall 13*b* of the speed increaser housing member 13 via the rear housing member 16 and the peripheral wall 12*b* of the motor housing member 12. A fourth connection passage 64 has a first end, which is connected to the discharge port 57*b* of the oil pump 57. The fourth connection passage 64 has a second end, which is located inside the peripheral wall 13*b* of the speed increaser housing member 13.

The oil passage 60 includes a first branch passage 65 and a second branch passage 66, which branch from the second end of the fourth connection passage 64. The first branch passage 65 extends toward the motor housing member 12 from the second end of the fourth connection passage 64, and opens in the through-hole 13*h*.

The second branch passage 66 extends toward the plate 14 from the second end of the fourth connection passage 64. The second branch passage 66 opens in the peripheral wall 13*b* of the speed increaser housing member 13.

The oil passage 60 includes a common passage 67, which is connected to the second branch passage 66. The common passage 67 has a first end, which is connected to the second branch passage 66. The common passage 67 has a second end, which is located inside the plate 14. The oil passage 60 includes a seal member-side supply passage 69 and a speed increaser-side supply passages 70, which branch from the second end of the common passage 67. The seal member-side supply passage 69 has a first end, which is connected to the common passage 67. The seal member-side supply passage 69 has a second end, which opens in the insertion hole 14*h*. Each speed increaser-side supply passage 70 has a first end, which is connected to the common passage 67. The seal member-side supply passage 69 has a second end, which opens in a section in the corresponding upright wall 41 that is opposed to the outer circumferential surface of the corresponding roller portion 35*a*. The speed increaser-side supply passages 70 are thus connected to the speed increaser chamber 13*c*.

The centrifugal compressor 10 includes a pressure relief passage 90, which connects the upper part of the oil pan 56 and a pressure relief hole 90*b*, which opens in the outer surface of the housing 11, to each other.

Figure 3:
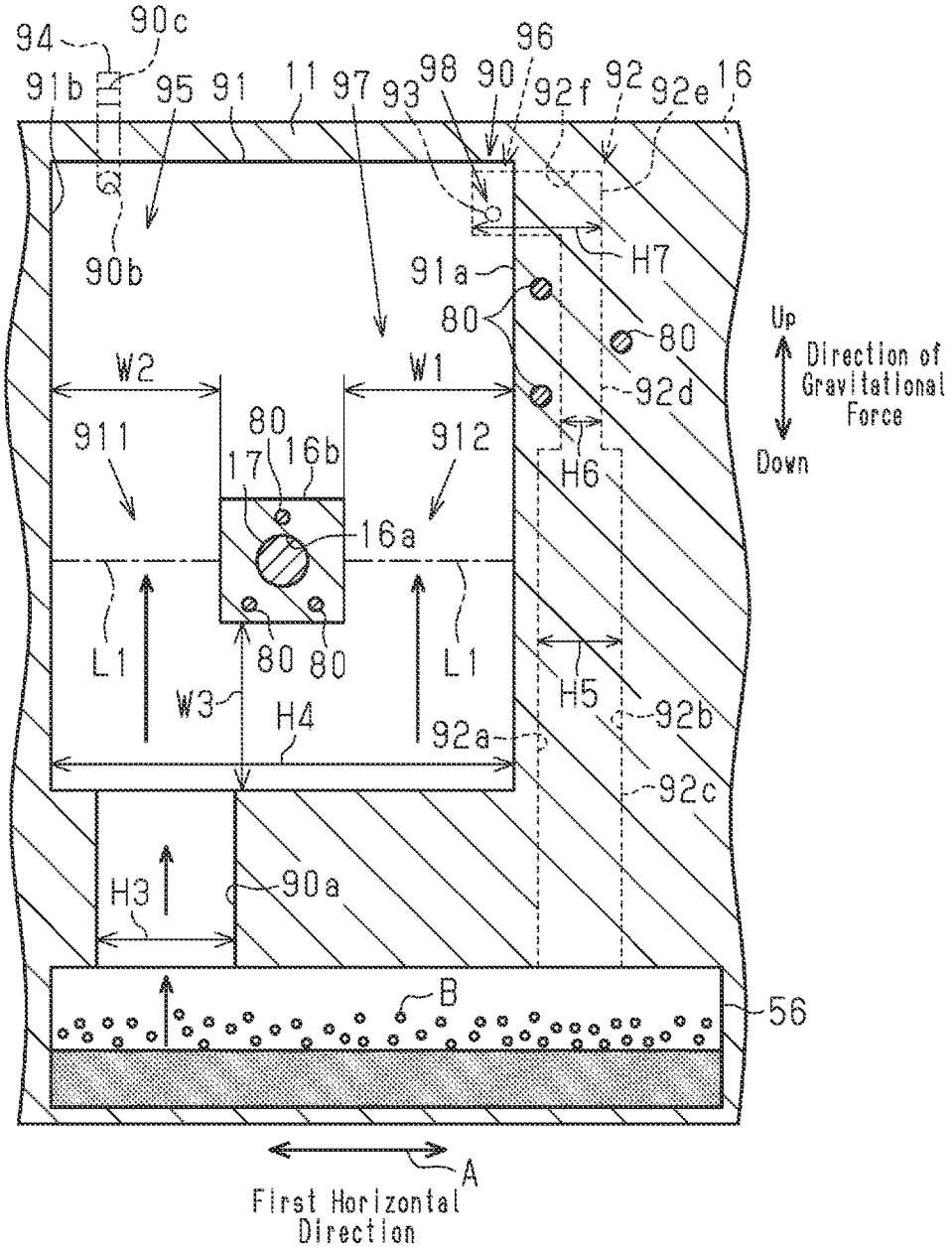
FIG. 3 is a cross-sectional view taken along line 3-3 in FIG. 1.
Figure 4:
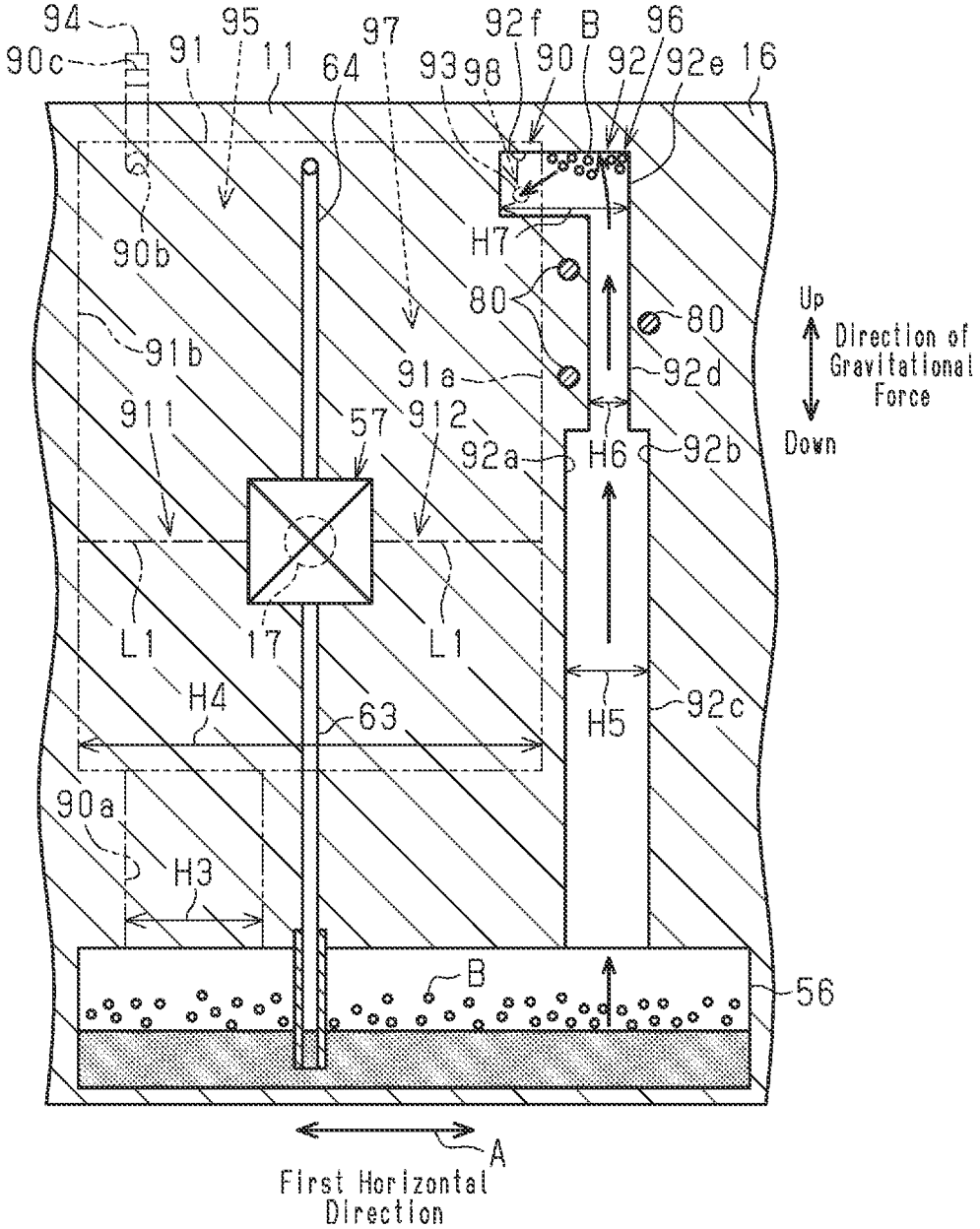
FIG. 4 is a cross-sectional view taken along line 4-4 in FIG. 1.

As shown in FIGS. 1, 3, and 4, the pressure relief passage 90 includes a connection passage 90*a*, a first buffer chamber 91, a second buffer chamber 92, and a communicating passage 93. The connection passage 90*a*, the first buffer chamber 91, the second buffer chamber 92, and the communicating passage 93 are formed in the rear housing member 16.

The first buffer chamber 91 is arranged above the oil pan 56. The first buffer chamber 91 has a rectangular shape extending in the direction of gravitational force when viewed in the axial direction of the low speed shaft 17 and in the radial direction of the low speed shaft 17. The connection passage 90*a* connects the oil pan 56 and the first buffer chamber 91 to each other. The connection passage 90*a* has a first end, which opens in the upper part in the oil pan 56. The connection passage 90*a* has a second end, which opens in the lower part in the first buffer chamber 91. The connection passage 90*a* has a rectangular shape extending in the direction of gravitational force when viewed in the axial direction of the low speed shaft 17. The connection passage 90*a* has a rectangular shape extending in the direction of gravitational force when viewed in the radial direction of the low speed shaft 17. As shown in FIG. 1, in the axial direction of the low speed shaft 17, the width of the connection passage 90*a* and the width of the first buffer chamber 91 are the same (a width H1). In the axial direction of the low speed shaft 17, the position of the connection passage 90*a* and the position of the first buffer chamber 91 agree with each other. As shown in FIG. 3, in the radial direction of the low speed shaft 17, a width H3 of the connection passage 90*a* is smaller than a width H4 of the first buffer chamber 91.

As shown in FIGS. 1, 3, and 4, the second buffer chamber 92 is connected to the oil pan 56. The second buffer chamber 92 extends upward from the oil pan 56 and is parallel with the first buffer chamber 91. The second buffer chamber 92 extends to a height comparable to the height of the first buffer chamber 91 in the direction of gravitational force.

Among the horizontal directions, which are perpendicular to the direction of gravitational force, a direction that is perpendicular to the low speed shaft 17 is defined as a first horizontal direction A. As shown in FIG. 1, the second buffer chamber 92 has a rectangular shape extending in the direction of gravitational force when viewed in the first horizontal direction A. In the axial direction of the low speed shaft 17, a width H2 of the second buffer chamber 92 is the same as the width H1 of the connection passage 90*a* and the first buffer chamber 91.

The connection passage 90*a* and the first buffer chamber 91 are displaced from the second buffer chamber 92 in the axial direction of the low speed shaft 17. The second buffer chamber 92 is arranged between the first buffer chamber 91 and the motor housing member 12 in the axial direction of the low speed shaft 17.

As shown in FIGS. 3 and 4, the first buffer chamber 91 and the second buffer chamber 92 are displaced from each other in the first horizontal direction A when viewed in the axial direction of the low speed shaft 17.

The housing 11 has a first side surface 91*a* and a second side surface 91*b*, which are opposed to each other in the first horizontal direction A and define the first buffer chamber 91. The first side surface 91*a* is located closest to the second buffer chamber 92, and the second side surface 91*b* is located on a side opposite to the second buffer chamber 92. The housing 11 has a first side surface 92*a* and a second side surface 92*b*, which are opposed to each other in the first horizontal direction A and define the second buffer chamber 92. When the second buffer chamber 92 is viewed in the axial direction of the low speed shaft 17, the second buffer chamber 92 is adjacent to the first side surface 91*a* in the first horizontal direction A. When the second buffer chamber 92 is viewed in the axial direction of the low speed shaft 17, the first side surface 92*a* is adjacent to the first side surface 91*a* in the first horizontal direction A. In the first horizontal direction A, the second side surface 92*b* is on the side opposite to the first buffer chamber 91.

As shown in FIGS. 1, 3, and 4, the communicating passage 93 connects the first buffer chamber 91 and the second buffer chamber 92 to each other. The communicating passage 93 connects the upper part of the first buffer chamber 91 and the upper part of the second buffer chamber 92 to each other. The communicating passage 93 extends in the axial direction of the low speed shaft 17.

As shown in FIGS. 1 and 3, a rectangular pillar-shaped protrusion 16*b* is arranged in the first buffer chamber 91. The protrusion 16*b* has an insertion hole 16*a*, through which the low speed shaft 17 is passed. In the first buffer chamber 91, the protrusion 16*b* is arranged to connect two inner walls that are opposed to each other in the axial direction of the low speed shaft 17. The protrusion 16*b* is formed integrally with the two inner walls.

As shown in FIG. 3, the protrusion 16*b* is located halfway between the first side surface 91*a* and the second side surface 91*b* in the first horizontal direction A. The protrusion 16*b* is located between the upper part of the first buffer chamber 91 and the lower part of the first buffer chamber 91. The protrusion 16*b* is arranged at a position below the center of the first buffer chamber 91 in the direction of gravitational force.

The cross section of the protrusion 16*b* when cut in the radial direction of the low speed shaft 17 is square. The width of the space between the first side surface 91*a* and a side surface of the protrusion 16*b* that is opposed to the first side surface 91*a* is defined as a width W1. The width of the space between the second side surface 91*b* and a side surface of the protrusion 16*b* that is opposed to the second side surface 91*b* is defined as a width W2. The width W1 and the width W2 are equal to each other. The width of the space between the lower part of the first buffer chamber 91 and a side surface of the protrusion 16*b* that is opposed to the lower part of first buffer chamber 91 is defined as a width W3. The width W3 is the same as the widths W1, W2. The widths W1, W2, W3 are larger than the width H3 of the connection passage 90*a*.

The first buffer chamber 91 includes a first passage 911 formed between the protrusion 16*b* and the second side surface 91*b*. The first buffer chamber 91 includes a second passage 912. The second passage 912 includes a passage formed between the protrusion 16*b* and the lower part of the first buffer chamber 91, and a passage formed between the protrusion 16*b* and the first side surface 91*a*. The lower part of the first passage 911 is connected to the connection passage 90*a*. The second passage 912 extends from the first passage 911 toward the first side surface 91*a* and extends upward, detouring the protrusion 16*b*. The first passage 911 and the second passage 912 are connected to each other in a region in the first buffer chamber 91 that is above the protrusion 16*b*. The first passage 911 and the second passage 912 share the region in the first buffer chamber 91 that is above the protrusion 16*b*. Three of the bolts 80 that fasten the motor housing member 12 and the rear housing member 16 together are passed through the protrusion 16*b*.

As shown in FIG. 1, the pressure relief hole 90*b* is formed in the wall of the rear housing member 16 that is on the side opposite to the motor housing member 12. The pressure relief hole 90*b* has a first end, which opens in the upper part in the first buffer chamber 91. The pressure relief hole 90*b* has a second end, which opens in the outer surface of the rear housing member 16. That is, the first buffer chamber 91 is connected to the outside of the housing 11 via the pressure relief hole 90*b*.

The pressure relief hole 90*b* is formed to extend in the axial direction of the low speed shaft 17. A pressure relief pipe 94 is provided on the outer surface of the rear housing member 16 in which the pressure relief hole 90*b* opens. The pressure relief pipe 94 is a tubular member that is bent in an L-shape. The pressure relief pipe 94 has a first end, which is connected to the pressure relief hole 90*b*. The pressure relief pipe 94 has a second end, which is located above the first end of the pressure relief pipe 94 and opens upward. A ventilation film 90*c* is arranged in the second end of the pressure relief pipe 94. The ventilation film 90*c* allows passage of gas but blocks liquid.

As shown in FIGS. 3 and 4, the connection passage 90*a*, the first passage 911, and the region in the first buffer chamber 91 that is above the protrusion 16*b* form a first pressure relief passage 95. The pressure relief passage 90 thus includes the first pressure relief passage 95. The pressure relief hole 90*b* is provided in the upper part of the first pressure relief passage 95.

The second passage 912 and the region in the first buffer chamber 91 that is above the protrusion 16*b* form a detouring pressure relief passage 97. The pressure relief passage 90 thus includes the detouring pressure relief passage 97. The first passage 911 and the second passage 912 share a region in the upper part in the first buffer chamber 91. Therefore, the detouring pressure relief passage 97 extends from the lower part of the first pressure relief passage 95 to the region above the protrusion 16*b*, detouring the protrusion 16*b*.

The second buffer chamber 92 and the communicating passage 93 form a second pressure relief passage 96. The pressure relief passage 90 thus includes the second pressure relief passage 96. The second pressure relief passage 96 is connected, by the communicating passage 93, to the upper region in the first buffer chamber 91 that is close to the first side surface 91*a*. The first pressure relief passage 95 and the second pressure relief passage 96 extend from the oil pan 56 in a branching manner. The second pressure relief passage 96 merges with the first pressure relief passage 95 to form a merging portion 98. The merging portion 98 refers to a connection portion at which the first buffer chamber 91 and the communicating passage 93 are connected to each other.

The first pressure relief passage 95 and the detouring pressure relief passage 97 share the region in the upper part in the first buffer chamber 91. The detouring pressure relief passage 97 and the second pressure relief passage 96 are thus connected to the merging portion 98.

The merging portion 98 is arranged in a region above the second passage 912, which is formed in the vicinity of the first side surface 91*a*. The merging portion 98 is formed in an upper region in the vicinity of the first side surface 92*a* of the second buffer chamber 92 in the first horizontal direction A. Accordingly, the first pressure relief passage 95 and the detouring pressure relief passage 97 are provided below the merging portion 98.

The pressure relief hole 90*b* is arranged in a region above the first passage 911, which is formed in the vicinity of the second side surface 91*b*. The pressure relief hole 90*b* is formed in an upper region in the direction of gravitational force that is in the vicinity of the second side surface 91*b* of the first buffer chamber 91 in the first horizontal direction A.

The pressure relief hole 90*b* and the merging portion 98 are spaced apart from each other in the first horizontal direction A. When the position in the direction of gravitational force is referred to as a height, the height of the merging portion 98 from the oil pan 56 is smaller than the height of the pressure relief hole 90*b* from the oil pan 56. That is, the pressure relief hole 90*b* is arranged at a position diagonally above the merging portion 98. That is, the pressure relief hole 90*b* is arranged above the merging portion 98.

As shown FIG. 4, the second buffer chamber 92 includes a proximal side passage 92*c*, an upper side passage 92*d*, and a stagnation portion 92*e*. The proximal side passage 92*c* is the lower end of the second pressure relief passage 96 and is connected to the upper part of the oil pan 56. The stagnation portion 92*e* is the upper end of the second pressure relief passage 96 and is connected to the communicating passage 93.

The proximal side passage 92*c* extends upward from the oil pan 56. The proximal side passage 92*c* has a first end, which is connected to the oil pan 56. The proximal side passage 92*c* has a second end, which is located above the oil pump 57. A width H5 of the proximal side passage 92*c* in the first horizontal direction A is smaller than the width H3 of the connection passage 90*a*.

The upper side passage 92*d* is connected to the proximal side passage 92*c*. The upper side passage 92*d* extends upward from the second end of the proximal side passage 92*c*. The upper side passage 92*d* has a first end, which is connected to the second end of the proximal side passage 92*c*. The upper side passage 92*d* is formed to extend among the bolts 80 that are not the three bolts 80 used to fix the oil pump 57. A width H6 of the upper side passage 92*d* in the first horizontal direction A is smaller than the width H5 of the proximal side passage 92*c*. The distance in the first horizontal direction A between the bolts 80 on the opposite sides of the upper side passage 92*d* is set such that the cross-sectional flow area of the upper side passage 92*d* is smaller than the cross-sectional flow area of the proximal side passage 92*c*.

The stagnation portion 92*e* is connected to the upper side passage 92*d*. The stagnation portion 92*e* is connected to the second end of the upper side passage 92*d*. The stagnation portion 92*e* is formed in the end of the second buffer chamber 92 that is on a side opposite to the oil pan 56. A width H7 of the stagnation portion 92*e* is larger than the width H5 of the proximal side passage 92*c* and the width H6 of the upper side passage 92*d*.

The stagnation portion 92*e* includes a wall surface 92*f*, which is located on a side opposite to the upper side passage 92*d* and intersects with the direction of gravitational force. The wall surface 92*f* extends in the first horizontal direction A. The stagnation portion 92*e* is formed in the upper part of the second buffer chamber 92.

As shown in FIGS. 3 and 4, an upper region of the first buffer chamber 91 in the vicinity of the first side surface 91*a* and a part of the stagnation portion 92*e*, which is an upper region of the second buffer chamber 92 in the vicinity of the first side surface 92*a*, overlap with each other in the axial direction of the low speed shaft 17.

The communicating passage 93 is formed in a part in which the upper regions of the first buffer chamber 91 and the second buffer chamber 92 overlap with each other in the axial direction of the low speed shaft 17. The communicating passage 93 extends in the axial direction of the low speed shaft 17. The communicating passage 93 connects the second buffer chamber 92 and the first buffer chamber 91 to each other on the downstream side in the flowing direction of oil in relation to the wall surface 92*f* of the stagnation portion 92*e*.

Figure 5:
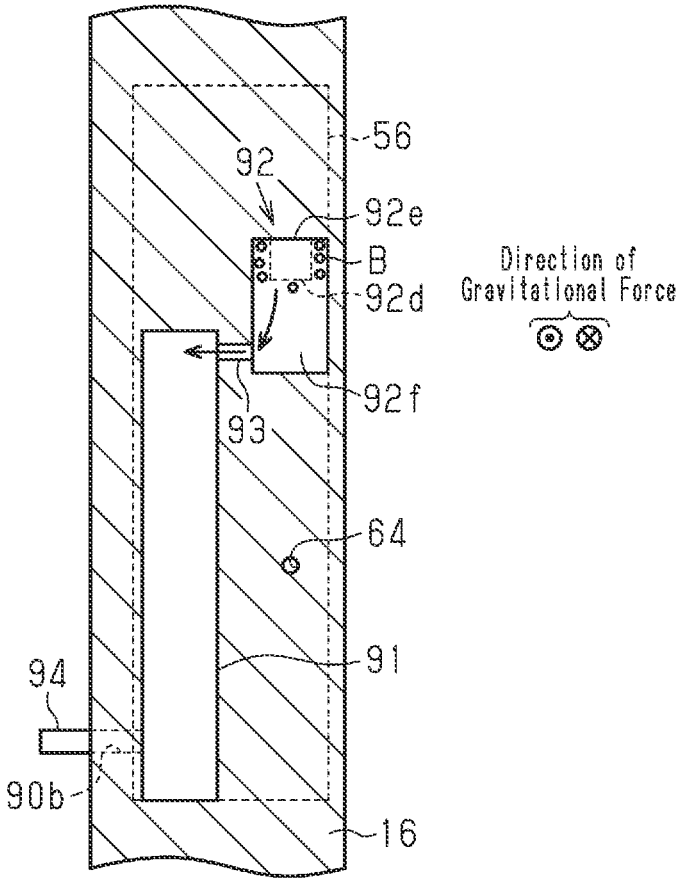
FIG. 5 is a cross-sectional view taken along line 5-5 in FIG. 1.

As shown FIG. 5, the direction in which the second buffer chamber 92 extends and the direction in which the communicating passage 93 extends intersect with each other. The direction in which the second pressure relief passage 96 extends from the oil pan 56 is bent toward the communicating passage 93. That is, the direction in which oil flows is changed from the direction of gravitational force to the axial direction of the low speed shaft 17.

The cross-sectional flow areas of the first pressure relief passage 95, the second pressure relief passage 96, and the detouring pressure relief passage 97 in the pressure relief passage 90 will now be described. The cross-sectional flow areas refer to cross-sectional areas when the passage is cut in a direction perpendicular to the flowing direction of oil.

As shown in FIGS. 3 and 4, in the first pressure relief passage 95, the cross-sectional flow area of the connection passage 90*a* is smaller than the cross-sectional flow area of the first passage 911. The cross-sectional flow areas of the connection passage 90*a* and the first passage 911 are smaller than the cross-sectional flow area of the region in the first buffer chamber 91 above the protrusion 16*b*. That is, the minimum cross-sectional flow area of the first pressure relief passage 95 is the cross-sectional flow area of the connection passage 90*a*.

In the detouring pressure relief passage 97, the cross-sectional flow area of a passage formed between the protrusion 16*b* and the lower part of the first buffer chamber 91 and the cross-sectional flow area of a passage formed between the protrusion 16*b* and the first side surface 91*a* are the minimum cross-sectional flow areas. In the present embodiment, the minimum cross-sectional flow area of the detouring pressure relief passage 97 is the same as the cross-sectional flow area of the first passage 911.

In the second pressure relief passage 96, the cross-sectional flow area of the proximal side passage 92*c* is larger than the cross-sectional flow area of the upper side passage 92*d*. The cross-sectional flow areas of the proximal side passage 92*c* and the upper side passage 92*d* are smaller than the cross-sectional flow area of the stagnation portion 92*e*. The cross-sectional flow areas of the proximal side passage 92*c* and the upper side passage 92*d* are larger than the cross-sectional flow area of the communicating passage 93. That is, the largest cross-sectional flow area of the second pressure relief passage 96 is the cross-sectional flow area of the stagnation portion 92*e*. The minimum cross-sectional flow area of the second pressure relief passage 96 is the cross-sectional flow area of the communicating passage 93. The cross-sectional flow area of the communicating passage 93 is smaller than the cross-sectional flow area of the connection passage 90*a*, which is the minimum cross-sectional flow area of the first pressure relief passage 95. The cross-sectional flow area of the upper side passage 92*d* is smaller than the cross-sectional flow areas of the stagnation portion 92*e* and the proximal side passage 92*c*. In the second pressure relief passage 96, the upper side passage 92*d* serves as a constriction.

The cross-sectional flow area of the stagnation portion 92*e*, which is the largest cross-sectional flow area of the second pressure relief passage 96, is smaller than the cross-sectional flow area of the connection passage 90*a*, which is the minimum cross-sectional flow area of the first pressure relief passage 95. That is, the cross-sectional flow area of the second pressure relief passage 96 is smaller than the cross-sectional flow area of the first pressure relief passage 95 over the entire length in the direction of gravitational force. The cross-sectional flow area of the stagnation portion 92*e*, which is the largest cross-sectional flow area of the second pressure relief passage 96, is smaller than the cross-sectional flow area of the second passage 912, which is the minimum cross-sectional flow area of the detouring pressure relief passage 97.

An operation of the present embodiment will now be described.

When the electric motor 18 is activated, rotation of the low speed shaft 17 drives the oil pump 57. Then, the oil stored in the oil pan 56 is drawn into the oil pump 57 through the third connection passage 63 and the suction port 57*a*, and discharged to the fourth connection passage 64 through the discharge port 57*b*. The oil discharged to the fourth connection passage 64 flows through the fourth connection passage 64 to be distributed to the first branch passage 65 and the second branch passage 66.

The oil distributed to the first branch passage 65 from the fourth connection passage 64 flows through the first branch passage 65 and into the through-hole 13*h* to be supplied to the seal member 21 and the second bearing 20. This ensures favorable lubrication of the sliding portions of the seal member 21 and the low speed shaft 17, and the sliding portions of the second bearing 20 and the low speed shaft 17.

The oil distributed to the second branch passage 66 from the fourth connection passage 64 flows into the common passage 67 via the second branch passage 66. Some of the oil that flows in the common passage 67 is distributed to the seal member-side supply passage 69, and the remaining oil flows in the speed increaser-side supply passages 70. The oil that is distributed to the seal member-side supply passage 69 from the common passage 67 flows in the seal member-side supply passage 69 to flow into the insertion hole 14*h* to be supplied to the seal member 71. The oil that flows in the speed increaser-side supply passages 70 is supplied to the outer circumferential surfaces of the roller portions 35*a*. This ensures favorable lubrication of the sliding portions of the roller portions 35*a* and the high speed shaft 31. The oil supplied to the seal member 71 and the outer circumferential surfaces of the roller portions 35*a* is returned to the speed increaser chamber 13*c*.

As shown in FIG. 1, the oil in the speed increaser chamber 13*c* is stirred by the speed increaser 30. This generates bubbles B in the oil. The bubbles B in the oil generated in the speed increaser chamber 13*c* reach the oil pan 56 through the oil passage 60.

As shown in FIGS. 3 and 4, the bubbles B that have reached the oil pan 56 are retained in the oil pan 56. The retained bubbles B raise the level of the oil stored in the oil pan 56. The level of the oil then reaches the first pressure relief passage 95 and the second pressure relief passage 96.

In the present embodiment, the cross-sectional flow area of the stagnation portion 92*e*, which is the largest cross-sectional flow area of the second pressure relief passage 96, is smaller than the cross-sectional flow area of the connection passage 90*a*, which is the minimum cross-sectional flow area of the first pressure relief passage 95. That is, the cross-sectional flow area of the second pressure relief passage 96 is smaller than the cross-sectional flow area of the first pressure relief passage 95 over the entire length. The bubbles B in the oil stored in the oil pan 56 are thus more likely to be drawn into the second pressure relief passage 96 by capillary action than into the first pressure relief passage 95. The level of the oil is thus not likely to reach the pressure relief hole 90*b* in the first pressure relief passage 95.

The present embodiment has the following advantages.

(1) The cross-sectional flow area of the second pressure relief passage 96 is smaller than the cross-sectional flow area of the first pressure relief passage 95 over the entire length. The bubbles B in the oil stored in the oil pan 56 are thus more likely to be drawn into the second pressure relief passage 96 by capillary action than into the first pressure relief passage 95. The bubbles B in the oil are thus not likely to reach the pressure relief hole 90*b* in the first pressure relief passage 95. This prevents the level of the oil from reaching the pressure relief hole 90*b* of the pressure relief passage 90.

(2) The pressure relief passage 90 includes the detouring pressure relief passage 97. Even if the level of oil reaches the first pressure relief passage 95 in the oil pan 56, and the level of the oil rises to the long-dash short-dash line L1 in FIGS. 3 and 4, the oil is drawn into the second pressure relief passage 96. Also, the second pressure relief passage 96 may be filled with bubbles, so that the bubbles B reach the first pressure relief passage 95. Even in this case, the bubbles B are readily drawn into the detouring pressure relief passage 97 since the largest cross-sectional flow area of the second pressure relief passage 96 is larger than the minimum cross-sectional flow area of the detouring pressure relief passage 97. This prevents the level of the oil from reaching the pressure relief hole 90*b* of the pressure relief passage 90.

(3) The bubbles B in the oil flowing into the second pressure relief passage 96 reach the detouring pressure relief passage 97 via the merging portion 98. In the present embodiment, the pressure relief hole 90*b* is spaced apart from the merging portion 98. This prevents oil that has reached the merging portion 98 from reaching the pressure relief hole 90*b* of the pressure relief passage 90.

(4) The second pressure relief passage 96 has the upper side passage 92*d*, which serves as a constriction. This locally reduces the cross-sectional flow area of the second pressure relief passage 96. The bubbles B in the oil stored in the oil pan 56 thus readily flow toward the second pressure relief passage 96. This further reduces the amount of the bubbles B in the oil flowing into the first pressure relief passage 95. This prevents the level of the oil from reaching the pressure relief hole 90*b* of the pressure relief passage 90.

(5) The pressure relief hole 90*b* is arranged above the merging portion 98. Thus, the oil that has reached the merging portion 98 is returned to the first pressure relief passage 95, which is located below the merging portion 98, and is not likely to reaching the pressure relief hole 90*b*. This prevents the level of the oil from reaching the pressure relief hole 90*b* of the pressure relief passage 90.

(6) The bubbles B in the oil drawn into the second pressure relief passage 96 are crushed by the bent portion of the second pressure relief passage 96 when reaching the communicating passage 93. When reaching the merging portion 98 from the communicating passage 93, oil is returned to the oil pan 56 via the first pressure relief passage 95. When reaching the merging portion 98 from the communicating passage 93, gas is discharged to the outside of the housing 11 via the pressure relief hole 90*b*. That is, the oil stored in the oil pan 56 is unlikely to gush out with the bubbles B from the pressure relief hole 90*b*. This limits a reduction in the amount of oil supplied to the speed increaser 30.

(7) The bubbles B in the oil flowing into the second pressure relief passage 96 reach the first buffer chamber 91 via the communicating passage 93 and the merging portion 98. In the present embodiment, the pressure relief hole 90*b* is spaced apart from the communicating passage 93 and the merging portion 98. This prevents oil from reaching the pressure relief hole 90*b* from the merging portion 98.

(8) Oil stagnates at the stagnation portion 92*e*. The pressure at the stagnation portion 92*e* is therefore higher than the pressure in a section of the second buffer chamber 92 on the upstream side of the stagnation portion 92*e*. The bubbles B in the oil are thus broken by the pressure at the stagnation portion 92*e*.

When the bubbles B that have not been removed at the stagnation portion 92*e* reach the first buffer chamber 91, which is larger than the communicating passage 93, via the communicating passage 93, the bubbles B in the oil that has reached the first buffer chamber 91 are removed through changes in the pressure. Accordingly, the oil stored in the oil pan 56 is prevented from gushing out with bubbles B from the pressure relief hole 90*b* of the pressure relief passage 90. This limits a reduction in the amount of oil supplied to the speed increaser 30.

(9) The bubbles B in the oil that has reached the stagnation portion 92*e* collide with the wall surface 92*f* of the stagnation portion 92*e*, and disappear when colliding with the wall surface 92*f*.

(10) The bubbles B in the oil are more likely to flow to the second buffer chamber 92 than to the first buffer chamber 91, and the bubbles B are removed by the stagnation portion 92*e* and the bent portion of the second pressure relief passage 96. This prevents oil from leaking from the pressure relief hole 90*b*. Accordingly, the reliability of the centrifugal compressor 10 is improved.

(11) Taking leakage of oil from the pressure relief hole 90*b* into consideration, the centrifugal compressor 10 preferably stores a great amount of oil. In this respect, the present embodiment prevents oil leakage and thus allows for reduction in the total amount of sealed-in oil of the centrifugal compressor 10. This reduces the manufacturing costs of the centrifugal compressor 10.

(12) The pressure relief passage 90 is provided with the ventilation film 90*c*, which allows passage of gas but blocks liquid. The ventilation film 90*c* prevents foreign matter and water from entering the centrifugal compressor 10 from the outside through the pressure relief passage 90.

(13) Since the bubbles B in the oil are prevented from reaching the pressure relief hole 90*b*, the ventilation film 90*c* is prevented from being clogged.

The present embodiment may be modified as follows. The present embodiment and the following modifications can be combined as long as the combined modifications remain technically consistent with each other.

The pressure relief passage 90 may be formed by the first pressure relief passage 95 and the detouring pressure relief passage 97, without the second pressure relief passage 96. For example, the pressure relief passage 90 may be modified as illustrated in FIG. 6.

Figure 6:
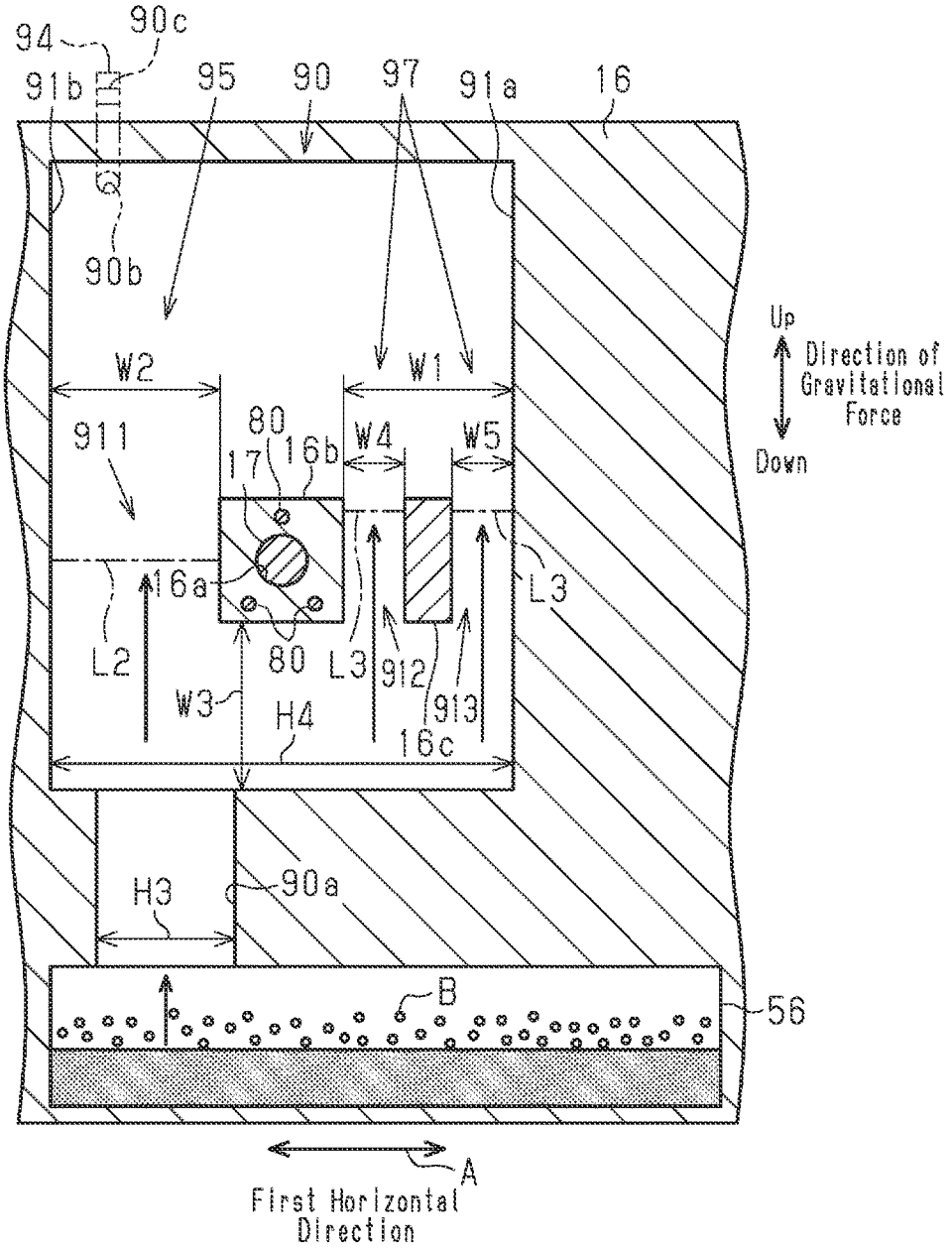
FIG. 6 is a cross-sectional view of a first passage and a second passage according to a modification.

As shown in FIG. 6, the first buffer chamber 91 incorporates a second protrusion 16*c*, which is adjacent to the protrusion 16*b* in the first horizontal direction A. In the first buffer chamber 91, the second protrusion 16*c* is arranged to connect two inner walls that are opposed to each other in the axial direction of the low speed shaft 17. The second protrusion 16*c* is formed integrally with the two inner walls.

The second protrusion 16*c* is located halfway between the first side surface 91*a* and the protrusion 16*b* in the first horizontal direction A. The second protrusion 16*c* is arranged in the vicinity of the lower part of the first buffer chamber 91 in the direction of gravitational force.

The cross section of the second protrusion 16*c* when cut in the radial direction of the low speed shaft 17 is rectangular. The width of the second protrusion 16*c* in the direction of gravitational force is the same as the width of the protrusion 16*b* in the direction of gravitational force. The width of the space between a side surface of the protrusion 16*b* that is opposed to the first side surface 91*a* and a side surface of the second protrusion 16*c* that is opposed to the protrusion 16*b* is defined as a width W4. The width of the space between the first side surface 91*a* and a side surface of the second protrusion 16*c* that is opposed to the first side surface 91*a* is defined as a width W5. The width W4 and the width W5 are equal to each other. The widths W4, W5 are smaller than the width W2.

The first buffer chamber 91 includes a second passage 912. The second passage 912 includes a passage formed between the protrusion 16*b* and the lower part of the first buffer chamber 91, and a passage formed between the protrusion 16*b* and the second protrusion 16*c*. A third passage 913 is formed in the first buffer chamber 91. The third passage 913 includes a passage formed between the lower part of the first buffer chamber 91 and the set of the protrusion 16*b* and the second protrusion 16*c*, and a passage formed between the second protrusion 16*c* and the first side surface 91*a*.

The second passage 912 extends from the first passage 911 toward the first side surface 91*a*. The second passage 912 also extends upward, detouring the protrusion 16*b*. The third passage 913 extends from the first passage 911 toward the first side surface 91*a*. The third passage 913 also extends upward, detouring the second protrusion 16*c*.

The first passage 911, the second passage 912, and the third passage 913 are connected to each other in a region in the first buffer chamber 91 that is above the protrusion 16*b* and the second protrusion 16*c*. The first passage 911, the second passage 912, and the third passage 913 share the region in the first buffer chamber 91 that is above the protrusion 16*b* and the second protrusion 16*c*.

The detouring pressure relief passage 97 is formed by the second passage 912, the third passage 913, and the region in the first buffer chamber 91 that is above the protrusion 16*b* and the second protrusion 16*c*. The detouring pressure relief passage 97 is connected to the first pressure relief passage 95, detouring the protrusion 16*b* and the second protrusion 16*c*.

The minimum cross-sectional flow area of the detouring pressure relief passage 97 is the cross-sectional flow area of the second passage 912 and the third passage 913. The minimum cross-sectional flow area of the detouring pressure relief passage 97 is smaller than the minimum cross-sectional flow area of the first pressure relief passage 95.

In this case, the cross-sectional flow area of the second passage 912 and the third passage 913, which is the minimum cross-sectional flow area of the detouring pressure relief passage 97, are smaller than the cross-sectional flow area of the connection passage 90*a*, which is the minimum cross-sectional flow area of the first pressure relief passage 95. Accordingly, the bubbles B in the oil stored in the oil pan 56 are likely to be drawn into the detouring pressure relief passage 97, in which capillary action is more likely to occur than in the first pressure relief passage 95. Thus, the level of the oil reaches the long-dash short-dash line L2 in FIG. 6 in the first pressure relief passage 95. On the other hand, in the detouring pressure relief passage 97, the level of the oil reaches the long-dash short-dash lines L3 in FIG. 6, which are higher than the long-dash short-dash line L2. The bubbles B in the oil are thus not likely to reach the pressure relief hole 90*b* in the first pressure relief passage 95. This prevents the level of the oil from reaching the pressure relief hole 90*b* of the pressure relief passage 90.

In the modification shown in FIG. 6, the second protrusion 16*c* may be displaced toward the first side surface 91*a*, so that the width W4 is larger than the width W5. Alternatively, the second protrusion 16*c* may be displaced toward the second side surface 91*b*, so that the width W5 is larger than the width W4.

Figure 7:
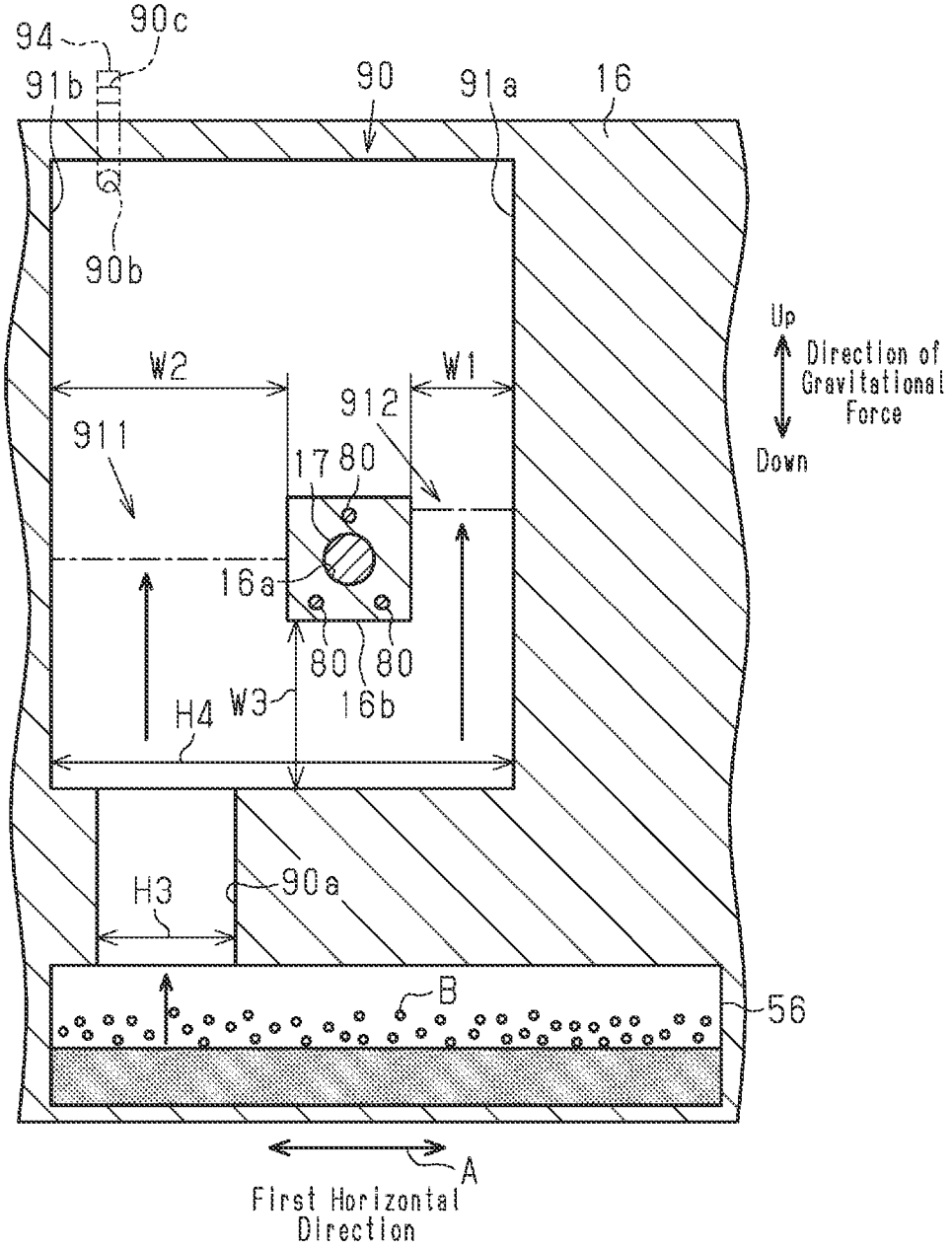
FIG. 7 is a cross-sectional view of a first passage and a second passage according to another modification.

As shown in FIG. 7, in the configuration in which the pressure relief passage 90 is formed by the first pressure relief passage 95 and the detouring pressure relief passage 97, the protrusion 16*b* may be arranged to be closer to the first side surface 91*a* in the first horizontal direction A, so that the width W2 is larger than the width W1. That is, the minimum cross-sectional flow area of the detouring pressure relief passage 97 may be the cross-sectional flow area of the second passage 912.

The pressure relief hole 90*b* may be arranged to be directly above the merging portion 98 in the direction of gravitational force. In this case, the pressure relief hole 90*b* is arranged above the merging portion 98.

The pressure relief hole 90*b* and the merging portion 98 may be located at the same position in the direction of gravitational force.

The pressure relief hole 90*b* and the merging portion 98 may be located at the same position in the axial direction of the low speed shaft 17.

The oil pan 56, the oil pump 57, the oil passage 60, the first buffer chamber 91, and the second buffer chamber 92 may be formed in the motor housing member 12 without fastening the rear housing member 16 to the motor housing member 12 with the bolts 80.

The connection passage 90*a*, the first buffer chamber 91, the second buffer chamber 92, and the communicating passage 93 do not necessarily need to be formed inside the rear housing member 16, but may be formed between the rear housing member 16 and the motor housing member 12.

The proximal side passage 92*c* has the second end, which is located above the oil pump 57 in the direction of gravitational force, in the above-described embodiment. However, the second end of the proximal side passage 92*c* may be located below the oil pump 57. In this case, the first end of the upper side passage 92*d* may extend to the second end of the proximal side passage 92*c*.

The second buffer chamber 92 may be changed to connect the proximal side passage 92*c* directly to the stagnation portion 92*e*.

The pressure relief hole 90*b* may be arranged above the first passage 911, which is formed in the vicinity of the first side surface 91*a*. In this case, the pressure relief hole 90*b* and the communicating passage 93 preferably do not overlap with each other in the axial direction of the low speed shaft 17.

In the above-described embodiment, the connection passage 90*a* and the first buffer chamber 91 are displaced from the second buffer chamber 92 in the axial direction of the low speed shaft 17, and the second buffer chamber 92 is arranged closer to the motor housing member 12 than the first buffer chamber 91 in the axial direction of the low speed shaft 17. However, the present disclosure is not limited to this. For example, the connection passage 90*a* may be located at the same position in the axial direction of the low speed shaft 17 as the first buffer chamber 91 and the second buffer chamber 92. In this case, the communicating passage 93 may be changed to extend in the first horizontal direction A, and the first buffer chamber 91 and the second buffer chamber 92 may be connected to each other.

In the configuration in which the pressure relief passage 90 includes the first pressure relief passage 95, the second pressure relief passage 96, and the detouring pressure relief passage 97, the connection passage 90*a* may be formed by the first pressure relief passage 95 and the first buffer chamber 91, and the detouring pressure relief passage 97 may be formed outside the first buffer chamber 91. In this case, the detouring pressure relief passage 97 may be formed to connect the first pressure relief passage 95 and the second pressure relief passage 96 to each other.

In the configuration in which the pressure relief passage 90 includes the first pressure relief passage 95, the second pressure relief passage 96, and the detouring pressure relief passage 97, the detouring pressure relief passage 97 may be omitted from the pressure relief passage 90.

In the axial direction of the low speed shaft 17, the width H1 of the first buffer chamber 91 and the width H2 of the second buffer chamber 92 are the same in the above-described embodiment. However, the widths H1 and H2 may be different from each other. The widths H1, H2 may be changed as long as the cross-sectional flow area of the second pressure relief passage 96 is smaller than the cross-sectional flow area of the first pressure relief passage 95 over the entire length. The same change may be made to the above-described modifications.

The centrifugal compressor 10 may be employed in any suitable application to compress any type of gas. For example, the centrifugal compressor 10 may be employed in an air conditioner to compress refrigerant gas. Further, the centrifugal compressor 10 may be mounted on any structure other than a vehicle.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A centrifugal compressor, comprising:

a low speed shaft that is rotated by a drive source;

an impeller that is attached to a high speed shaft, which rotates at a speed higher than a speed of the low speed shaft;

a speed increaser that transmits power of the low speed shaft to the high speed shaft;

a housing that includes a drive source chamber that accommodates the drive source, an impeller chamber that accommodates the impeller, a speed increaser chamber that accommodates the speed increaser, and a dividing wall having an insertion hole through which the high speed shaft is passed, the dividing wall dividing the impeller chamber and the speed increaser chamber from each other;

a seal member provided between an outer circumferential surface of the high speed shaft and an inner circumferential surface of the insertion hole;

an oil pan that stores oil supplied to the speed increaser; and a pressure relief passage that connects an upper part of the oil pan to a pressure relief hole that opens in an outer surface of the housing, wherein the pressure relief passage includes a first pressure relief passage and a second pressure relief passage, the pressure relief hole is arranged above the first pressure relief passage in a direction of gravitational force, the second pressure relief passage merges with the first pressure relief passage to form a merging portion, and a maximum cross-sectional flow area of the second pressure relief passage is smaller than a minimum cross-sectional flow area of the first pressure relief passage.

2. The centrifugal compressor according to claim 1, wherein the pressure relief passage includes a detouring pressure relief passage that extends, in a detouring manner, from a lower part of the first pressure relief passage and is connected to an upper part of the first pressure relief passage, and the maximum cross-sectional flow area of the second pressure relief passage is smaller than a minimum cross-sectional flow area of the detouring pressure relief passage.

3. The centrifugal compressor according to claim 2, wherein the detouring pressure relief passage and the second pressure relief passage are connected to each other via a merging portion, the housing includes a first side surface and a second side surface that are opposed to each other, the merging portion is formed in an upper region of the housing in a vicinity of the first side surface, and the pressure relief hole is formed in an upper region of the housing in a vicinity of the second side surface.

4. The centrifugal compressor according to claim 3, wherein the second pressure relief passage includes a constriction between a lower end connected to the upper part of the oil pan and an upper end connected to the merging portion, and a cross-sectional flow area of the constriction is smaller than a cross-sectional flow area of the upper end and a cross-sectional flow area of the lower end.

5. The centrifugal compressor according to claim 1, wherein the pressure relief hole is arranged above the merging portion, and the first pressure relief passage is arranged below the merging portion.

6. A centrifugal compressor, comprising:

a low speed shaft that is rotated by a drive source;

an impeller that is attached to a high speed shaft, which rotates at a speed higher than a speed of the low speed shaft;

a speed increaser that transmits power of the low speed shaft to the high speed shaft;

a housing that includes a drive source chamber that accommodates the drive source, an impeller chamber that accommodates the impeller, a speed increaser chamber that accommodates the speed increaser, and a dividing wall having an insertion hole through which the high speed shaft is passed, the dividing wall dividing the impeller chamber and the speed increaser chamber from each other;

a seal member provided between an outer circumferential surface of the high speed shaft and an inner circumferential surface of the insertion hole;

an oil pan that stores oil supplied to the speed increaser via an oil passage; and a pressure relief passage that connects an upper part of the oil pan to a pressure relief hole that opens in an outer portion of the housing, wherein the pressure relief passage includes a first pressure relief passage and a detouring pressure relief passage, the pressure relief hole is arranged above the first pressure relief passage in a direction of gravitational force, the detouring pressure relief passage includes a detouring pressure relief passage that extends, in a detouring manner, from a lower part of the first pressure relief passage to a region located in an upper part, and a minimum cross-sectional flow area of the detouring pressure relief passage is smaller than a minimum cross-sectional flow area of the first pressure relief passage.

* * * * *